US006820280B1

(12) United States Patent
Atallah et al.

(10) Patent No.: US 6,820,280 B1
(45) Date of Patent: Nov. 23, 2004

(54) RIP-OFF, HIGH-VISIBILITY, SAFETY VEST

(75) Inventors: Toufic G. Atallah, Reading, MA (US); Stephen J. Blauer, Lexington, MA (US)

(73) Assignee: Blaver Manufacturing Company, Inc., Boston, MA (US)

( * ) Notice: Subject to any disclaimer, the term of this patent is extended or adjusted under 35 U.S.C. 154(b) by 65 days.

(21) Appl. No.: 10/174,156

(22) Filed: Jun. 18, 2002

(51) Int. Cl.[7] ..... A41D 1/04
(52) U.S. Cl. ..... 2/102
(58) Field of Search ..... 2/102, 94, 69, 2/2.5, 462, 456, 108, 904, 92, 912, 913

(56) References Cited

U.S. PATENT DOCUMENTS

| | | | | |
|---|---|---|---|---|
| 3,848,267 A | * | 11/1974 | DeSpain | 2/94 |
| 5,495,621 A | * | 3/1996 | Kibbee | 2/2.5 |
| 5,890,227 A | * | 4/1999 | Brown | 2/102 |
| 5,976,669 A | * | 11/1999 | Fleming | 428/143 |
| D440,716 S | * | 4/2001 | Lesley | D29/101.4 |

OTHER PUBLICATIONS

ANSI/ISEA 107–1999—American National Standard for High–Visibility Safety Apparel.
ISEA–Safety Equipment Association–ANSI/SEA 107–1999 Jun. 1, 1999 American National Standard for High–Visibility Safety Apparel pp 1–16.

* cited by examiner

*Primary Examiner*—Tejash Patel
(74) *Attorney, Agent, or Firm*—Altman & Martin

(57) ABSTRACT

A light weight, high visibility vest, is intended to be worn over regular or service clothing. This vest comprises: a front panel and a back panel that extend from the neck to the hips or waist; mating fastener arrangements at the shoulders and hips detachably connecting the front and back panels; and front and rear retro-reflective bands spanning the front and the back panels. Preferably, the mating fastener arrangements at each of the shoulders include a front arrangement that is affixed to the upper edge of the front panel and a rear arrangement that is affixed to an upper edge of the back panel. When one or both of the panels are grasped and pulled, the mating fastener arrangements separate, thereby freeing the front and back panels from each other and from the wearers body.

27 Claims, 7 Drawing Sheets

RIP-OFF, HIGH-VISIBILITY, SAFETY VEST

BACKGROUND OF THE INVENTION

RELATED APPLICATIONS

Not Applicable

GOVERNMENT CONTRACTS

Not Applicable

FIELD OF THE INVENTION

The present invention relates to clothing and, more particularly, to high visibility vests, which are worn for safety, daytime or nighttime, over uniforms or other outer clothing, typically by personnel involved in police, fire, safety, hospital, and other public services.

THE PRIOR ART

High visibility articles of clothing typically incorporate combinations of luminescent and retro-reflective surfaces, which combine to provide brilliant contrast against relatively obscure daytime and nighttime backgrounds. As is well known, luminescent surfaces are coated or impregnated with chemical compositions (i.e. fluorescent or phosphorescent) that collect light, which may be of relatively low luminosity, e.g. ambient light, and respond by emitting light of relatively high luminosity. As is well known, retro-reflective surfaces (i.e. distributions of minute corner reflectors or high refractive index glass beads) return specular light in the direction of its source, e.g. vehicle headlights at night.

Regular clothing often is appropriate in service situations. Service clothing often is designed with safety as a special consideration. In any case, it is necessary to minimize the likelihood that a wearer may become a victim when clothing, particularly an accessory vest, is caught accidentally by a vehicle hazard, grasped deliberately during an assault, or contaminated by chemical or biological agents during a rescue effort.

BRIEF DESCRIPTION OF THE INVENTION

The object of the present invention is to provide a light weight, high visibility vest, which is intended to be slipped on and worn over regular or service clothing, but which may removed instantly if required. The vest of the present invention comprises: front and back luminescent panels that extend substantially from the shoulders to the waist or hips; mating fastener arrangements or other readily separable fastener arrangements, preferably at the shoulders and the waist or hips, connecting the front and back panels; and retro-reflective bands spanning the front and back panels and bordering regions for the presentation of alphanumeric or other graphic indicia. Preferably, the retroreflective bands include upper and lower horizontal bands, and retro-reflective bands that extend between the upper horizontal reflective bands and the shoulders, typically in parallel and/or intersecting orientations. Preferably, narrow matching trim bounds free edges of the front and back panels, and opposed edges of the retro-reflective bands. The trim at the free edges is provided by selvedge fabric that overlaps the free edges. The trim at the edges of the bands is provided by backing fabric that extends oppositely beyond the longitudinal edges of the bands. The vest structure is neat and authoritative in appearance, is effectively vivid and informative in operation, and may be easily and instantaneously ripped away from a wearer when required for safety.

BRIEF DESCRIPTION OF THE DRAWINGS

For a fuller understanding of the nature and objects of the present invention, reference is made to the following specification, which is to be taken in connection with the accompanying drawings wherein.

DETAILED DESCRIPTION OF THE PREFERRED EMBODIMENTS

Figure 1:
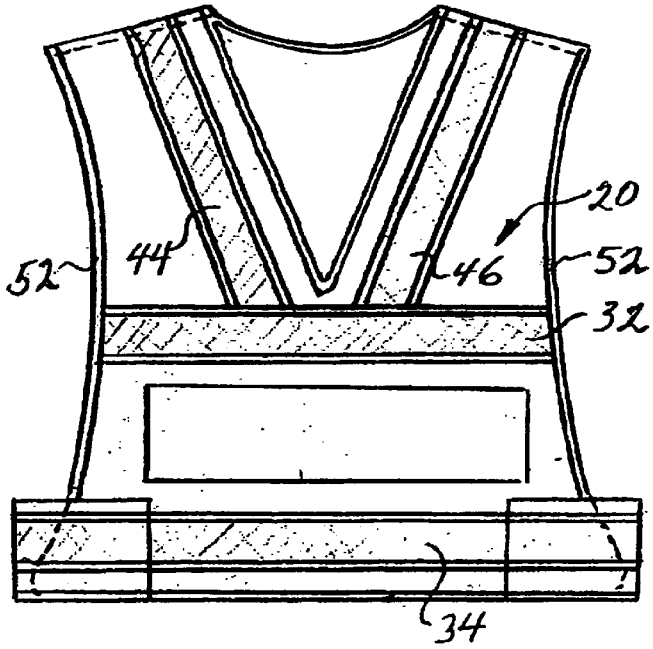
FIG. 1 is a front view of a vest embodying the present invention.
Figure 2:
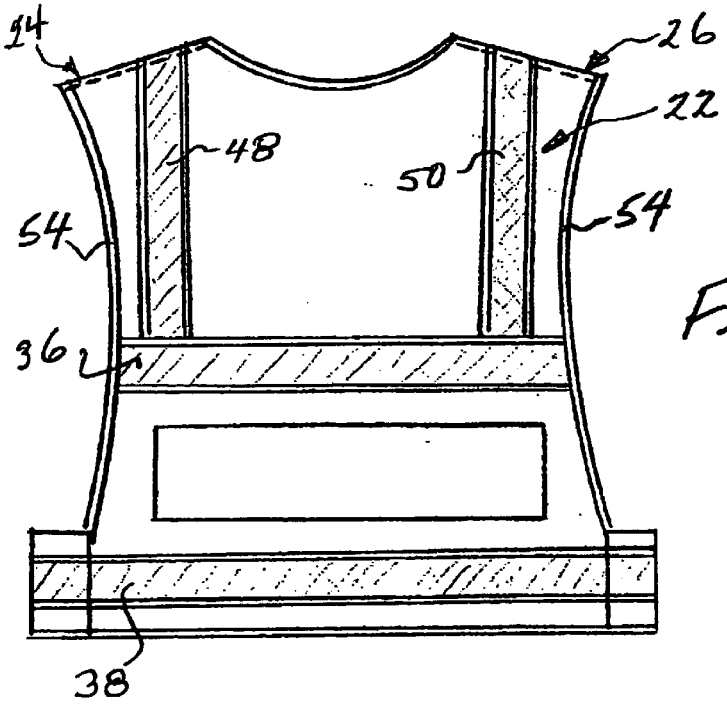
FIG. 2 is a back view of the vest of FIG. 1.
Figure 3:
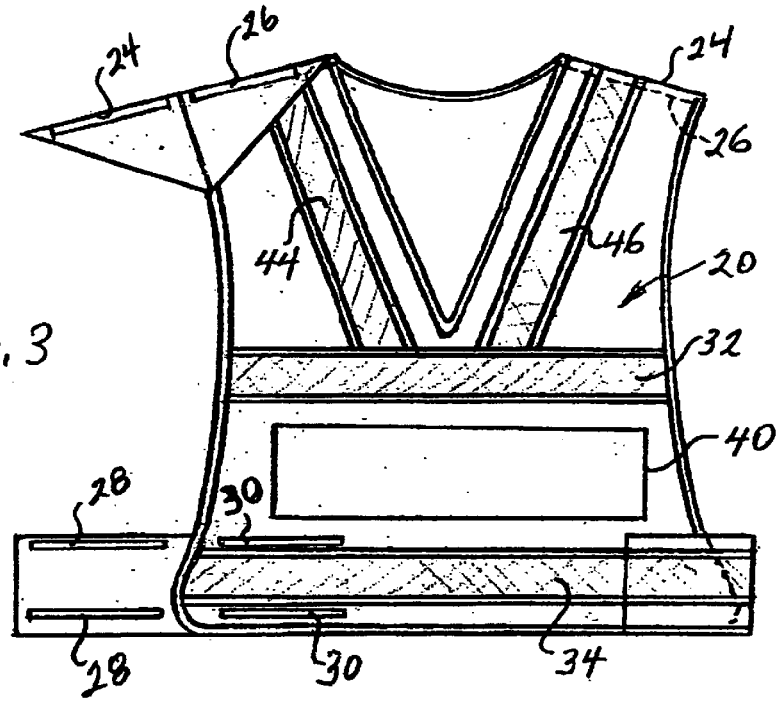
FIG. 3 is a front view of the vest of FIG. 1, partly disassembled to illustrate significant features.
Figure 4:
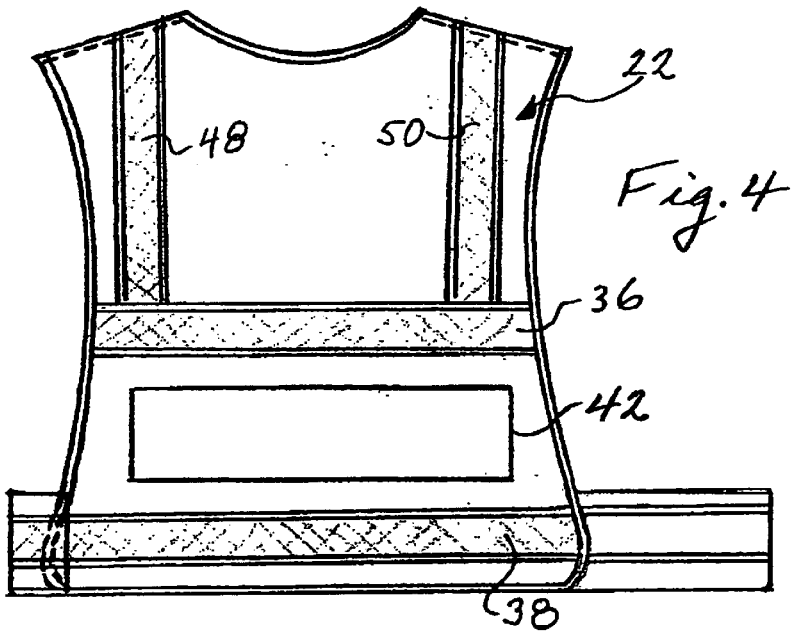
FIG. 4 is a back view of the vest of FIG. 1, partly disassembled to illustrate significant features.

The vest of FIGS. 1 to 4.

The vest illustrated in FIGS. 1 to 4 comprises: front and back luminescent panels 20 and 22 that extend from the shoulders to the waist or hips. The front and back panels are joined by mating fastener arrangements or other easily separable fastener arrangements 24, 26 at the shoulders, and mating or other easily separable fastener strips 28, 30 at the waist or hips. Upper and lower horizontal retro-reflective bands 32, 34 span the front panel, and upper and lower horizontal retro-reflective bands 36, 38 span the back panel. Bands 32,34 define a region 40 therebetween for the presentation of alphanumeric or other graphic indicia. Bands 36, 38 define a region 42 therebetween for the presentation of alphanumeric or other graphic indicia.

As shown, retro-reflective bands 44, 46 on the front panel diverge from upper horizontal retro-reflective band 32 to the shoulders. As shown, retro-reflective bands 48, 50 on the back panel extend in parallel between the upper horizontal retro-reflective band and the shoulders. The upper ends of bands 44, 46 and the upper ends of bands 48, 50, respectively, meet to provide an appearance of continuity.

Figure 11:
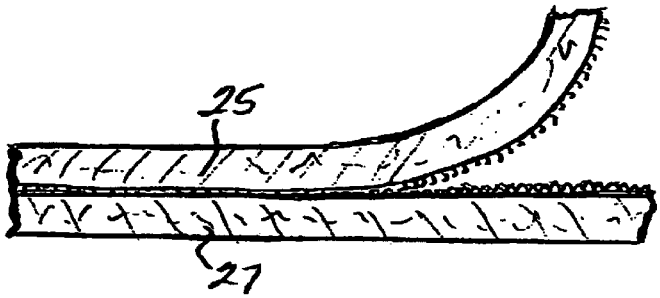
FIG. 11 is an exaggerated, broken-away, cross-section of a micro-meshing hook-and-loop mating fastener strip arrangement of a type used in the vests shown in FIGS. 1–4, 5–6, 7–8, and 9–10.
Figure 12:
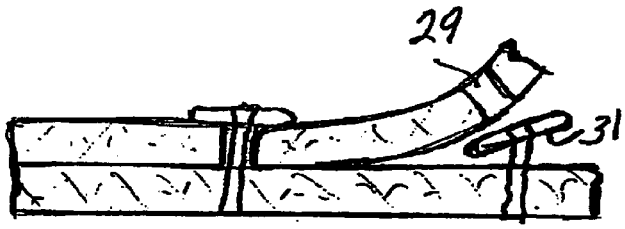
FIG. 12 is an exaggerated, broken-away, cross-section of an alternative mating fastener arrangement, in the form of a series of buttons and button-holes of a type that is alternately used in the vests shown in FIGS. 1–4, 5–6, 7–8, and 9–10.
Figure 13:
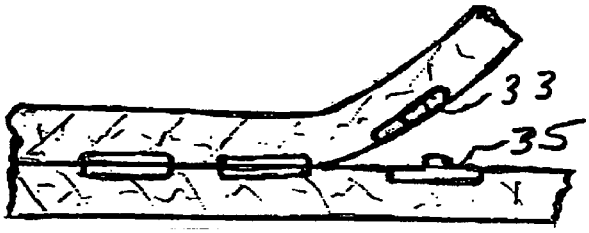
FIG. 13 is an exaggerated, broken-away, cross-section of another alternative mating fastener arrangement, in the form of a series of male and female snaps of a type that is alternately used in the vests shown in FIGS. 1–4, 5–6, 7–8, and 9–10.
Figure 14:
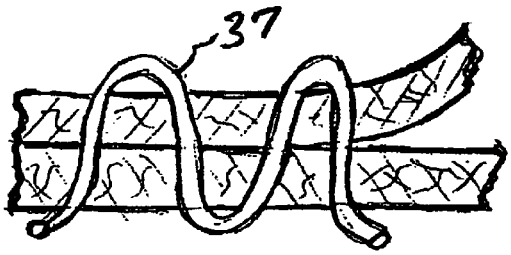
FIG. 14 is an exaggerated, broken-away, cross-sectional view of another alternative separable fastener arrangement in the form of a stay stitching assemblage of a type that is alternately used in the vests shown in FIGS. 1–4, 5–6, 7–8, and 9–10.

In the preferred form shown in FIGS. 1 to 4, fastener arrangements 24, 26 and fastener arrangements 28, 30 are constructed from mating pairs of hook-and-loop micro-meshing strips of the type sold by Velcro Industries BV under the trademark VELCRO. The construction of these hook-and-loop micro-meshing strips is suggested at 25, 27 in FIG. 11. It is to be understood that these mating arrangements, in less preferred forms, alternatively may be constructed from: series of button/buttonhole constructions as shown at 29, 31 in FIG. 12; series of male/female snap constructions as shown at 33, 35 in FIG. 13; and temporary stay stitching as shown at 37 in FIG. 14.

Figure 15:
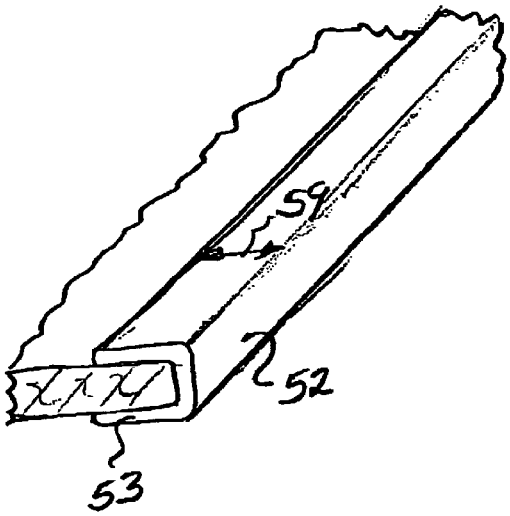
FIG. 15 is an exaggerated, broken-away, cross-sectional and orthogonal view of a selvedge of the vests shown in FIGS. 1–4, 5–6, 7–8, and 9–10.
Figure 16:
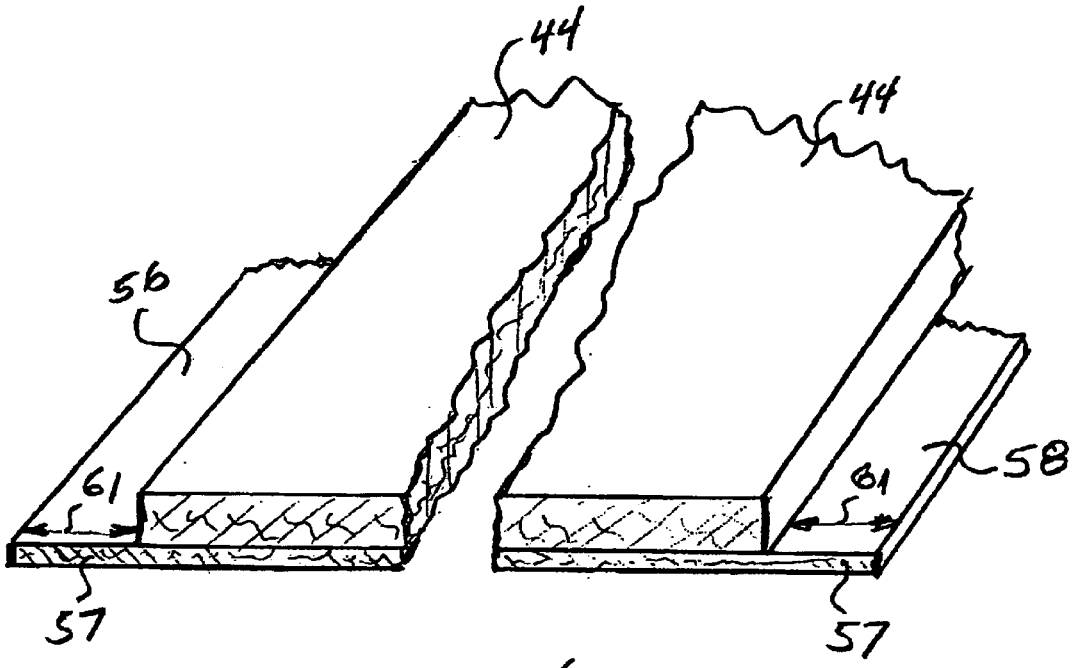
FIG. 16 is an exaggerated, broken-away, cross-sectional and orthogonal view of a retro-reflective band construction of a type that is used in the vests shown in FIGS. 1–4, 5–6, 7–8, and 9–10.

Preferably, as shown in FIGS. 1 to 4, aesthetic trim is provided at the free edges 52, 54 of the front and back panels and at the longitudinal edges 56, 58 of the retro-reflective bands. The structure of the trim at an edge 52 is shown in FIG. 15 to be an overlapping selvedge 53 that is reversely bent about the edge. The structure of the trim at the edges 56, 58 of a retro-reflective band is shown in FIG. 16 to be provided by an underlying backing 57 that extends oppositely beyond the edges of the band.

The panels, when normally viewed, typically are of highly luminescent color, particularly yellow, green, orange or white. The bands, when normally viewed, generally are dull gray. The trim provides a distinctive and sharp border at the free edges of the front and back panels, and at the edges of the bands. From a visual standpoint, the widths of the trim provided by the selvedges as at 59 and the widths of the trim provided by underlying backing 57 as at 61, are substantially equal for aesthetic harmony.

Preferably, front and back panels 20, 22 are composed of tightly knit or woven strands of polyester or polypropylene, and are characterized by a denier ranging from 70 to 500 and a weight ranging from 2 to 6 ounces per square yard. This polymeric fabric is finished with a high chromaticity fluorescent dye, for example ANSI standard EN471. The retro-reflective bands are sold by Minnesota Mining and Manufacturing Corporation under the trade designation, SCHOTCHLITE. The composition of the panel fabric is sufficiently light and breathable to enable its being worn, with virtually no ergonomic effect on underlying clothing under varied weather conditions. The Vest of FIGS. 5 and 6.

Figure 5:
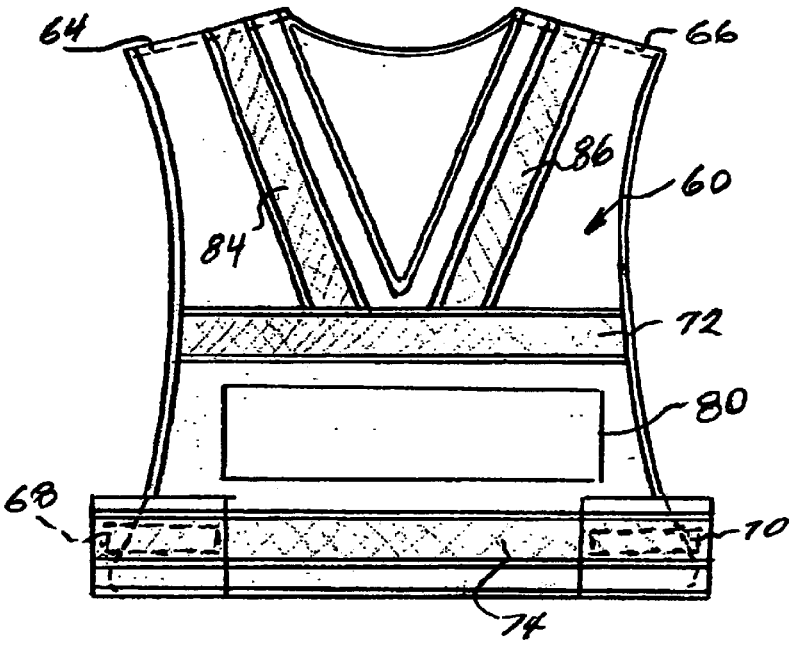
FIG. 5 is a front view of another vest embodying the present invention.
Figure 6:
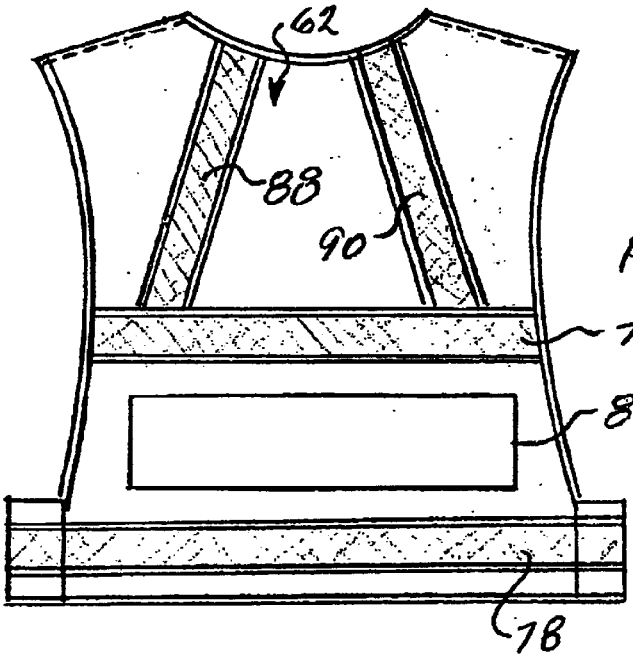
FIG. 6 is a back view of the vest of FIG. 5.

The vest illustrated in FIGS. 5 and 6 comprises: front and back luminescent panels 60 and 62 that extend between the shoulders and the waist or hips. The front and back panels are joined by mating or other easily separable fastener strips 64, 66 at the shoulders, and by mating or other easily separable fastener strips 68, 70 at the waist or hips. Upper and lower horizontal retro-reflective bands 72, 74 span the front panel, and upper and lower horizontal retro-reflective bands 76, 78 span the back panel. Bands 72, 74 define or border a region 80 therebetween for the presentation of alphanumeric or other graphic indicia. Bands 76, 78 define a region 82 therebetween for the presentation of alphanumeric or other graphic indicia.

As shown, upwardly converging retro-reflective bands 84, 86 on the front panel extend between the upper horizontal retro-reflective band and the shoulders. As shown, upwardly converging retro-reflective bands 88, 90 on the back panel extend between the upper horizontal retro-reflective band and the neck. The Vest of FIGS. 7 and 8.

Figure 7:
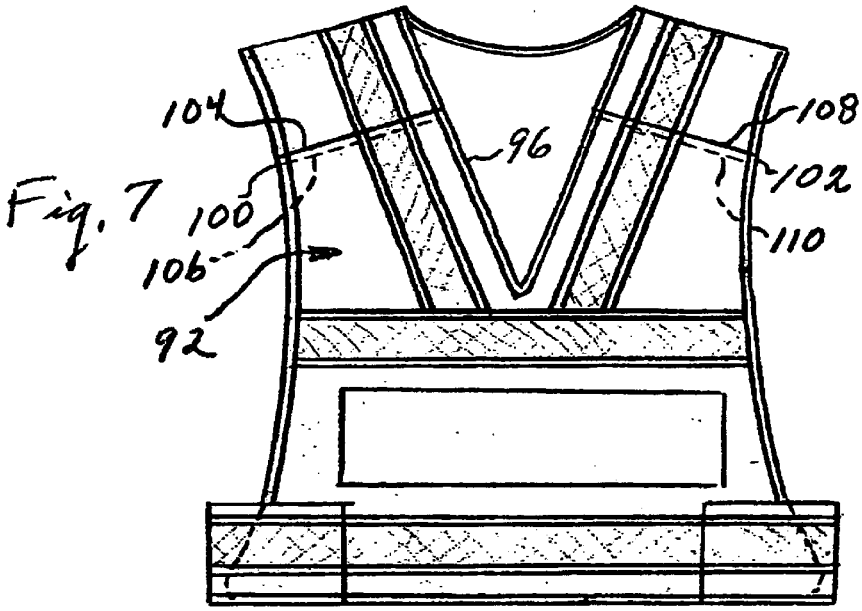
FIG. 7 is a front view of a further vest embodying the present invention.
Figure 8:
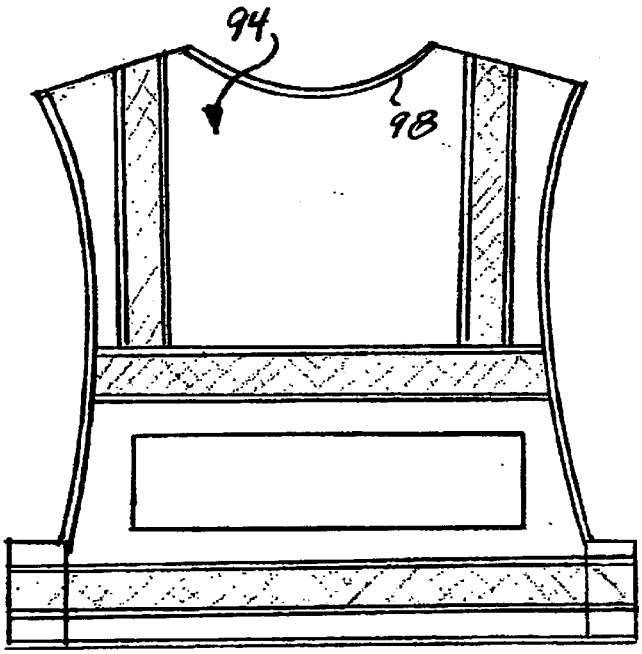
FIG. 8 is a back view of the vest of FIG. 7.

The vest illustrated in FIGS. 7 and 8 comprises: front and back luminescent panels 92 and 94 that extend between the shoulders and the waist or hips. Front panel 92 has V-neck opening 96. Back panel 94 has a turtle neck opening 98. Lower and upper sections of the front panel are separated along slits 100, 122, which extend from V-neck opening 96 to the openings at the arms. Joining the upper and lower sections of the front panel are mating or other easily separable fastener strips 104, 106 and 108, 110, which extend across the chest from V-neck opening 96 to the openings at the arms. The remaining elements of the vest of FIGS. 7 and 8 is similar to corresponding elements of the vest of FIGS. 1 to 4, except that the separable fastener strips at the shoulders of the vest of FIGS. 1 to 4 are omitted. The Vest of FIGS. 9 and 10.

Figure 9:
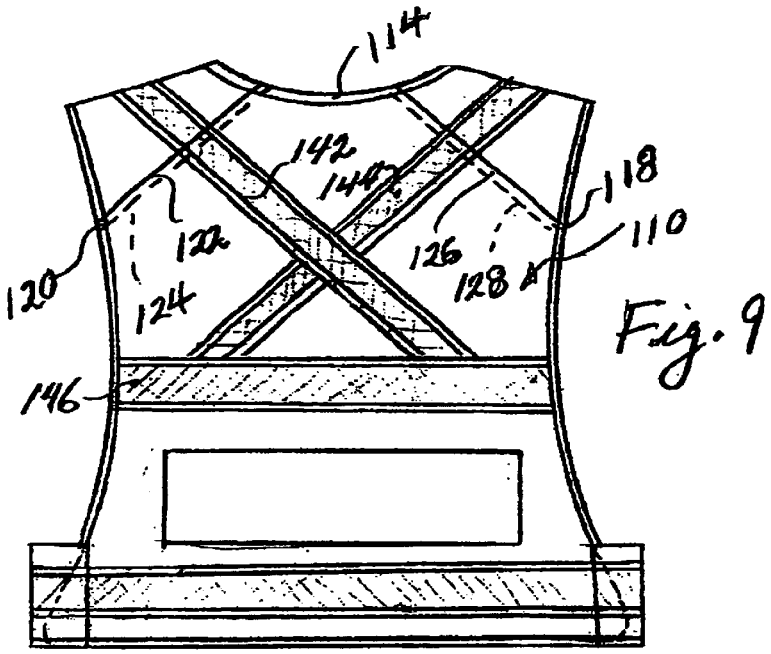
FIG. 9 is a front view of still a further vest of the present invention.
Figure 10:
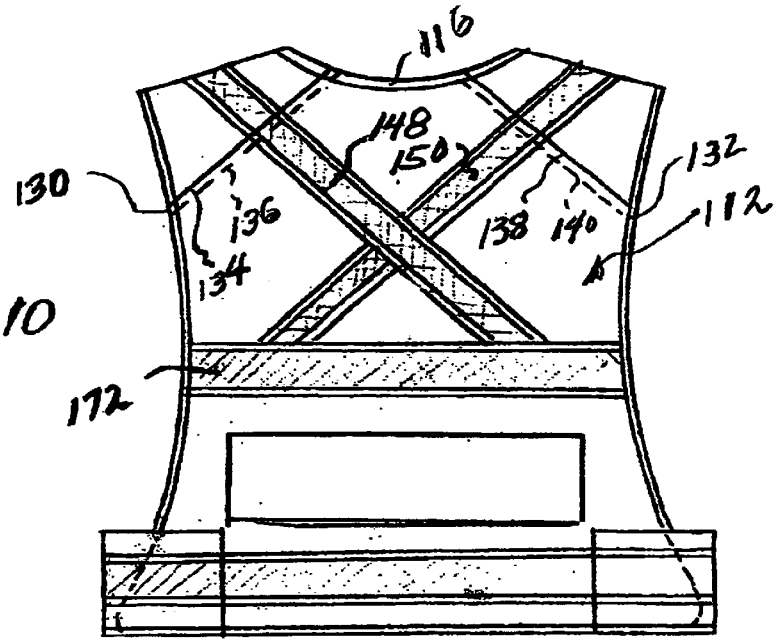
FIG. 10 is a back view of the vest of FIG. 9.

The vest illustrated in FIGS. 9 and 10 comprises: front and back luminescent panels 110 and 112 that extend between the shoulders and the waist or hips. Both the front and the back panels have poncho-neck openings, shown at 114 and 116. Lower and upper sections of the front panel are separated along slits 118, 120, which extend at from the neck opening to the openings at the arms. Joining the upper and lower sections of the front panel are mating or other easily separable fastener strips 122, 124 and 126, 128, which extend across the chest from the neck opening to the arm openings. Lower and upper sections of the back panel are separated along slits 130, 132, which extend from neck opening 116 to the arm openings. Joining the upper and lower sections of the front panel are easily mating or other easily separable fastener strips 134, 136 and 138, 140, which extend across the chest from neck opening 136 to the arm openings.

Across the front panel are intersecting retro-reflective bands 162, 164, which extend from the shoulders to a medial horizontal retroreflective band 146. Across the back panel are intersecting retroreflective bands 148, 150, which extend from the shoulders to a medial horizontal retroreflective band 172.

The remaining elements of the vest of FIGS. 9 and 10 are similar to corresponding elements of its counterpart in FIGS. 1 to 4, except that the slits at the shoulders and the associated fastener strips of FIGS. 1 to 4 are omitted.

The duplicate slits 118, 120 and 130, 132 and their associated fastening means on the front and back panels, in the structure of FIGS. 9 and 10, are intended to ensure emergency separation of the front and back panels, particularly where the fastening means are stay stitching.

OPERATION

A light weight, high visibility vest, is worn loosely over regular or service clothing. The vest comprises: front and back luminescent panels that extend from the shoulders to the hips; easily separable fastener means, particularly mating fastener means, at the shoulders and hips connecting the front and back panels; and upper and lower horizontal retro-reflective bands spanning the front and back panels and defining regions there between for the presentation of alphanumeric or other graphic indicia.

Visually sharp trim separates the bands and the panels. Preferably, the distance between the upper and lower bands ranges between 5 and 9 inches in order to provide adequate space for an alphanumeric graphic there between. The vest structure is neat and authoritative in appearance, is effectively vivid and informative in operation, and may be easily and instantaneously ripped away from a wearer when required for safety.

What is claimed is:

1. A high visibility, light weight vest comprising:

(a) front and back luminescent panels that extend from the shoulders to the waist and hip region;

(b) said panels being characterized by fabric having a denier ranging from 70 to 500 and a weight ranging from 2 to 6 ounces per square yard;

(c) mating fastener means in the vicinity of said shoulders and in the vicinity of said hips connecting said front and back luminescent panels; and (d) retro-reflective bands spanning said front luminescent panel and said back luminescent panel;

(e) whereby said front luminescent panel and said back luminescent panel are separable when one and/or the other is grasped and pulled.

2. The vest of claim 1 wherein said retro-reflective bands on said front luminescent panel and said retrofelective bands on said back luminescent panel bound front and back regions that display graphic visual matter.

3. The vest of claim 1 wherein lengths of trim visually bound said bands, and visually bound free edges of said panels.

4. The vest of claim 1 wherein lengths of trim visually bound said bands and visually bound said panels, said lengths of trim appearing to be substantially equal in transverse width throughout.

5. The vest of claim 1 wherein said fastener means include micro hook-and-loop strips.

6. The vest of claim 1 wherein said fastener means include mating series of male and female snaps.

7. The vest of claim 1 wherein said fastener means include mating series of buttons and buttonholes.

8. The vest of claim 1 wherein said fastener means include stay stitching.

9. The vest of claim 1 wherein said panels are fabricated from fibers composed of a polymer selected from the class consisting of polyester and polypropylene.

10. The vest of claim 1 wherein said panels are fabricated substantially from a fabric composed of polymeric fibers selected from the class consisting of polyesters and polypropylenes.

11. A high visibility vest comprising:

(a) front and back luminescent panels, said panels being characterized by fabric having a denier ranging from 70 to 500 and a weight ranging from 2 to 6 ounces per square yard;

(b) mating fastener means at the shoulders and the waist and hip region connecting said front and back panels;

(c) upper and lower retro-reflective bands spanning said front panel;

(d) upper and lower retro-reflective bands spanning said back panel;

(e) said upper and lower retro-reflective bands defining regions that display graphic visual matter;

(f) retro-reflective bands extending from said upper retro-reflective band on said front panel to said shoulders on said front panel;

(g) retro-reflective bands extending from said upper retro-reflective band on said back panel to said shoulders on said back panel; and (h) lengths of trim distinctively bounding edges of said bands, and distinctively bounding edges of said panels.

12. The vest of claim 11 wherein said fastener means include mating micro hook-and-loop strips.

13. The vest of claim 11 wherein said fastener means include mating series of male and female snaps.

14. The vest of claim 11 wherein said fastener means include mating series of buttons and buttonholes.

15. The vest of claim 11 wherein said fastener means include stay stitching.

16. The vest of claim 11 wherein said panels are fabricated from woven or knit fibers composed of a polymer selected from the class consisting of polyester and polypropylene.

17. The vest of claim 11 wherein said panels are fabricated from woven or knit polymeric fabric with fibers composed of a polymer selected from the class consisting of polyesters and polypropylenes, said fabric having a denier ranging from 70 to 500 and a weight ranging from 2 to 6 ounces per square yard.

18. A high visibility vest which is to be worn over regular or service clothing, said vest comprising:

(a) a front panel and a back panel that extend about the body;

(b) hook-and-loop micro-meshing strips at the upper body and the lower body detachably connecting said front panel and said back panel;

(c) a front lower retro-reflective band and a front upper retro-reflective band horizontally spanning body locations in substantial parallel;

(d) a back lower retro-reflective band and a back upper retro-reflective band horizontally spanning body locations in substantial parallel;

(e) retro-reflective bands on said front panel extending between said front upper horizontal band and strategic locations at said shoulders;

(g) retro-reflective bands on said back panel extending between said back upper horizontal band and strategic locations at said shoulders;

(h) said micro-meshing strips at each of said shoulders including a first mating strip that is sewn to an upper edge of said front panel, and a second mating strip that is sewn to an upper edge of said back panel;

(i) said lower back retro-reflective band being provided with opposed extensions that loop forwardly about said body and are fastened by said lower micro-meshing strips to the outer ends of the front retro-reflective band at said lower body;

(j) said opposed extensions having retro-reflective bands that visually are continuations of said lower back retro-reflective band and said lower front retro-reflective band;

(k) matching trim being provided at free edges of said front panel and said back panel by thin selvedges, said matching trim being reversely bent about said free edges; and (l) matching trim being provided at opposed longitudinal edges of said retro-reflective bands by underlying backing that extends oppositely beyond said opposed longitudinal edges of said bands;

(m) said front panel and said back panel being composed of a fabric composed of knit or woven strands of polyester or polypropylene, and are characterized by a denier ranging from 70 to 500 and a weight ranging from 2 to 6 ounces per square yard;

(n) said fabric being treated with a high chromaticity, high luminosity fluorescent dye;

(o) said vest being effectively vivid in operation, and said mating fastener strips being easily separated as a safety measure when needed;

(p) longitudinal edges of certain of said retro reflective bands being stitched to said front panel;

(q) longitudinal edges of certain of said retro reflective bands being stitched to said back panel;

(r) longitudinal edges of said retro-reflective bands being stitched to said underlying backing and said retro reflective bands.

19. The vest of claim 18 wherein said upwardly extending retro-reflective bands on said front panel are crossed.

20. A high visibility vest, said vest comprising:

(a) a front panel and a back panel that extend substantially from the shoulders substantially to the waist and hip region;

(b) hook-and-loop micro-meshing upper and lower mating fasteners at said shoulders and said hips detachably connecting said front panel and said back panel;

(c) front retro-reflective bands spanning the chest;

(d) back retro-reflective bands spanning the back;

(e) each of said micro-meshing mating fasteners at each of said shoulders including a first mating patch that is sewn to an upper edge of one of said panels, and a second mating patch that is sewn to an upper edge of the other of said panels;

(f) matching trim at free edges of said front panel and said back panel being presented by trim fabric that is reversely bent about said free edges; and (g) matching trim at opposed longitudinal edges of said retro-reflective bands being presented by backing fabric that extends oppositely behind said bands and beyond said opposed longitudinal edges of said bands;

(h) said front panel and said back panel being fabricated from strands of polyester or polypropylene, and being characterized by a denier ranging from 70 to 500 and a weight ranging from 2 to 6 ounces per square yard;

(i) said fabric of said front panel and of said back panel being treated with a high chromaticity, high luminosity fluorescent dye;

(j) said vest being effectively vivid in operation, and being easily ripped from a wearer for safety when needed.

21. A high visibility vest comprising:

(a) a front panel substantially spanning the front of the body and a back panel substantially spanning the back of the body;

(b) hook-and-loop micro-meshing upper and lower mating fasteners detachably connecting said front panel and said back panel at upper and lower locations thereof;

(c) said front panel and said back panel being composed of a textile that is characterized by a denier ranging from 70 to 500 and a weight ranging from 2 to 6 ounces per square yard, and that is fabricated from at least one member selected from the class consisting of polyester and polypropylene; and (d) said textile being treated with a luminous medium;

(e) said vest being adapted to be ripped from a wearer by separation of said micro-meshing mating fasteners.

22. A high visibility vest comprising:

(a) a front panel substantially spanning the front of the body and a back panel substantially spanning the back of the body, said front panel and said back panel extending substantially from shoulders to waist;

(b) hook-and-loop micro-meshing upper and lower mating fasteners at said shoulders and said waist detachably connecting said front panel and said back panel;

(c) said front panel and said back panel being composed of a textile that is characterized by a denier ranging from 70 to 500 and a weight ranging from 2 to 6 ounces per square yard, and that is fabricated from at least one member selected from the class consisting of polyester and polypropylene;

(d) said textile being associated with a luminous medium;

(e) said vest being adapted to be ripped from a wearer by separation of said micro-meshing patch combinations.

23. A high visibility vest comprising:

(a) a front panel substantially spanning the front of the body and a back panel substantially spanning the back of the body;

(b) hook-and-loop micro-meshing upper and lower mating fasteners detachably connecting said front panel and said back panel;

(c) front retro-reflective bands on said front panel;

(d) back retro-reflective bands on said back panel;

(f) matching trim visually presented at free edges of said front panel and free edges of said back panel;

(g) matching trim visually presented at opposed longitudinal edges of said bands by backing fabric that extends from behind said bands and oppositely beyond said opposed longitudinal edges of said bands;

(h) said matching trim at said free edges of said panels and said matching trim at said longitudinal edges of said bands having substantially the same normally observable transverse widths;

(i) said front panel and said back panel being composed of a textile that is characterized by a denier ranging from 70 to 500 and a weight ranging from 2 to 6 ounces per square yard, (j) said textile being treated with a high chromaticity, high luminosity fluorescent dye;

(k) said vest being adapted to be ripped from a wearer by separation of said micro-meshing patch combinations.

24. The high visibility vest of claim 23, wherein said textile is fabricated from at least one member of the class consisting of polyester and polypropylene.

25. A high visibility vest comprising:

(a) a front panel spanning the front of the body and a back panel spanning the back of the body;

(b) hook-and-loop micro-meshing upper and lower mating fasteners detachably connecting said front panel and said back panel;

(c) front retro-reflective bands on said front panel;

(d) back retro-reflective bands on said back panel;

(f) dark matching trim at free edges of said front panel and at free edges of said back panel;

(g) dark matching trim being visually presented at opposed longitudinal edges of said bands and being visually presented by backing fabric that extends from behind said bands and oppositely beyond said opposed longitudinal edges of said bands;

(i) said front panel and said back panel being composed of a textile that is characterized by a denier ranging from 70 to 500 and a weight ranging from 2 to 6 ounces per square yard, and that is fabricated from at least one member of the class consisting of polyester and polypropylene, and (j) said textile being treated with a high chromaticity, high luminosity fluorescent dye;

(k) said vest being adapted to be ripped easily from a wearer by separation of said micro-meshing patch combinations.

26. The high visibility vest of claim 25 wherein said matching trim at said free edges of said panels and said matching trim at said longitudinal edges of said bands having substantially the same normally observable transverse widths.

27. A high visibility vest, said vest comprising:

(a) a front panel spanning the chest and a back panel spanning the back;

(b) hook-and-loop micro-meshing upper and lower mating fasteners detachably connecting said front panel and said back panel;

(c) front retro-reflective bands on said front panel;

(d) back retro-reflective bands on said back panel;

(f) matching trim at free edges of said front panel and at free edges of said back panel;

(g) matching trim at opposed longitudinal edges of said bands and being presented by backing fabric that extends behind said bands and oppositely beyond said opposed longitudinal edges of said bands;

(h) said matching trim at said free edges of said panels and said matching trim at said longitudinal edges of said bands having substantially the same transverse widths;

(i) said front panel and said back panel being composed of a textile that is characterized by a denier ranging from 70 to 500 and a weight ranging from 2 to 6 ounces per square yard, and that is fabricated from at least one member of the class consisting of polyester and polypropylene, and (j) said textile being treated with a high chromaticity, high luminosity fluorescent dye;

(k) said vest being adapted to be ripped from a wearer easily by separation of said micro-meshing upper and lower patches.

* * * * *